United States Patent [19]

Forker

[11] 4,408,412

[45] Oct. 11, 1983

[54] TOY AIRCRAFT AND METHOD OF OPERATION

[76] Inventor: Richard O. Forker, 104 Oak Tree Ct., Logansport, Ind. 46947

[21] Appl. No.: 284,608

[22] Filed: Jul. 20, 1981

[51] Int. Cl.[3] ..... A63H 3/06

[52] U.S. Cl. ..... 46/89; 46/74 R; 244/155 R

[58] Field of Search ..... 46/1 H, 86 R, 86 A, 46/86 B, 86 C, 87, 88, 89, 74 R; 244/155 R, 153 R

[56] References Cited

U.S. PATENT DOCUMENTS

| | | | |
|---|---|---|---|
| 1,804,244 | 5/1931 | Brady | 46/88 |
| 2,701,935 | 2/1955 | Florence | 46/88 |
| 3,430,899 | 3/1969 | Zopf | 244/153 R |
| 3,664,613 | 5/1972 | Johnston | 244/155 R |
| 3,984,938 | 10/1976 | Cowdrick | 46/86 R |

FOREIGN PATENT DOCUMENTS

| | | | |
|---|---|---|---|
| 2902559 | 8/1979 | Fed. Rep. of Germany | 46/88 |
| 391014 | 8/1908 | France | 46/86 R |

*Primary Examiner*—Gene Mancene
*Assistant Examiner*—Kris R. Schulze
*Attorney, Agent, or Firm*—Albert L. Jeffers

[57] ABSTRACT

An aircraft toy adapted to use a gas for providing lift, and comprising a vessel for containing the gas, an eyeloop securely attached to the vessel, and a line having ends securely connected slidably through the eyeloop of the vessel for maintaining control thereof. Also provided are a transporting platform securely attached to the bottom of the vessel, a lightweight object for placement with the transporting platform, a string securely attached to the object and slidably attached to the line for controlling the object, a releasing device for releasing the object from the transporting platform, and a controlled descent device attached to the object. A method is also provided for operating the toy aircraft.

4 Claims, 11 Drawing Figures

TOY AIRCRAFT AND METHOD OF OPERATION

BACKGROUND OF THE INVENTION

This invention pertains to a toy aircraft, and more particularly to a toy aircraft wherein an object is released from the aircraft for controlled descent to the ground.

Toys of this nature are not new and in fact many have been developed over the years. However, this success has been short-lived due in part because their structural design made them too responsive to wind variations or to strong continuous winds causing the toy to dump the object prematurely to the ground. Additionally, problems have persistently existed in designing a structure with a sufficient lift-to-weight ratio so that an object could be satisfactorily carried aloft for subsequent release. These problems existed either because the object was too heavy, or the designs were aeronautically insufficient for the structure in use.

Furthermore, the prior art toy aircraft generally employed two lines. A first line would be connected from the toy aircraft to the operator, and a second line connected from the object to the operator. The two lines made it difficult for the operator to employ the toy aircraft because the lines would become intertwined by the wind resulting in the object being prematurely spilled from the toy or prevented from being released altogether.

The above problems and disadvantages have not been eliminated by the prior art at the present time. Some prior art toys may alternately solve or remedy one problem or one disadvantage, but none have solved all the problems or remedied any of the disadvantages to date. It is therefore a purpose of the invention to provide a toy aircraft which solves and remedies the problems and disadvantages described above.

SUMMARY OF THE INVENTION

The improved toy aircraft of the present invention prevents premature dumping of the object by eliminating the need of a large lifting surface. Whereas kites utilize a large lifting surface to fly the object aloft, the present invention utilizes a vessel, such as a balloon, blimp or the like, inflated with a lighter-than-air gas to provide the required lift to fly the toy aircraft and object aloft. The improved toy aircraft of the invention therefore eliminates the need of a large lifting surface and the accompanying sensitivity of the lifting surface to wind variation. The improved stability of the toy aircraft of the invention further prevents premature dumping of the object. As an aid in the prevention of the spilling of the object prematurely, the invention also provides for the object to be lightly attached to the aircraft by Velcro means.

The toy aircraft of the invention provides an improved lift-to-weight ratio over the prior art in that the toy aircraft of the invention does not rely on the wind to propel it aloft, but rather relies on a lighter-than-air gas for lift. Consequently, on a calm day, the present invention has a much greater lift-to-weight ratio than a toy utilizing a kite for lift purposes. Additionally, the lift-to-weight ratio may be easily increased by increasing the pressure of the lighter-than-air gas in the vessel. The lift-to-weight ratio of the toy of the invention is further improved by constructing the toy of lightweight materials. The vessel may be made of Mylar material, while the remainder of the toy may be made of styrofoam, lightweight plastic, and balsa wood.

The invention also eliminates the disadvantage of having two lines, and the accompanying intertwinement of those lines prematurely dumping the object. The invention requires the operator to hold only one line which is connected to the toy aircraft. This same line is further used by the operator to release the object from the vessel for controlled descent to the ground. To prevent the object from being carried away by the wind, a string is attached to the object and slidably attached to the line held by the operator.

It is an object of the invention to provide an improved toy aircraft having improved stability aloft thereby eliminating premature dumping of the object.

It is another object of the invention to provide a toy aircraft with sufficient lift-to-weight ratio to fly an object aloft without the assistance of the wind.

It is further another object of the invention to provide a toy aircraft which requires only one line to control both the aircraft and the release of the object therefrom.

It is a still further object of the invention to provide an improved toy aircraft which fulfills all of the aforementioned objects.

In the broader aspects of this invention, there is provided an improved toy aircraft comprising a vessel adapted for containing a lighter-than-air gas, an object support attached to the vessel, an object releasably attached to the object support, a line securely attached slidably to the aircraft with one end of the line releasably attached to the object and the other end of the line held by the operator of the toy aircraft, and descent means attached to the object, whereby the aircraft becomes airborne and the object may be released and controllably descended to the ground by pulling on the line. The method of the invention comprises the steps of providing a vessel adapted for containing a lighter-than-air gas, inflating the vessel with a lighter-than-air gas, attaching an object support to the vessel, attaching releasably an object to the object support, maintaining control of the aircraft by a line attached thereto, flying the aircraft aloft, releasing the object from the object support, descending controllably the object to the ground, and maintaining control of the object by a string attached to the object and slidably attached to the line.

BRIEF DESCRIPTION OF THE DRAWINGS

The above-mentioned and other features and objects of this invention, and the matter of attaining them, will become more apparent and the invention itself will be better understood by reference to the following description of an embodiment of the invention taken in conjunction with the accompanying drawings, wherein.

DESCRIPTION OF A SPECIFIC EMBODIMENT

Figures 1, 2, 3:
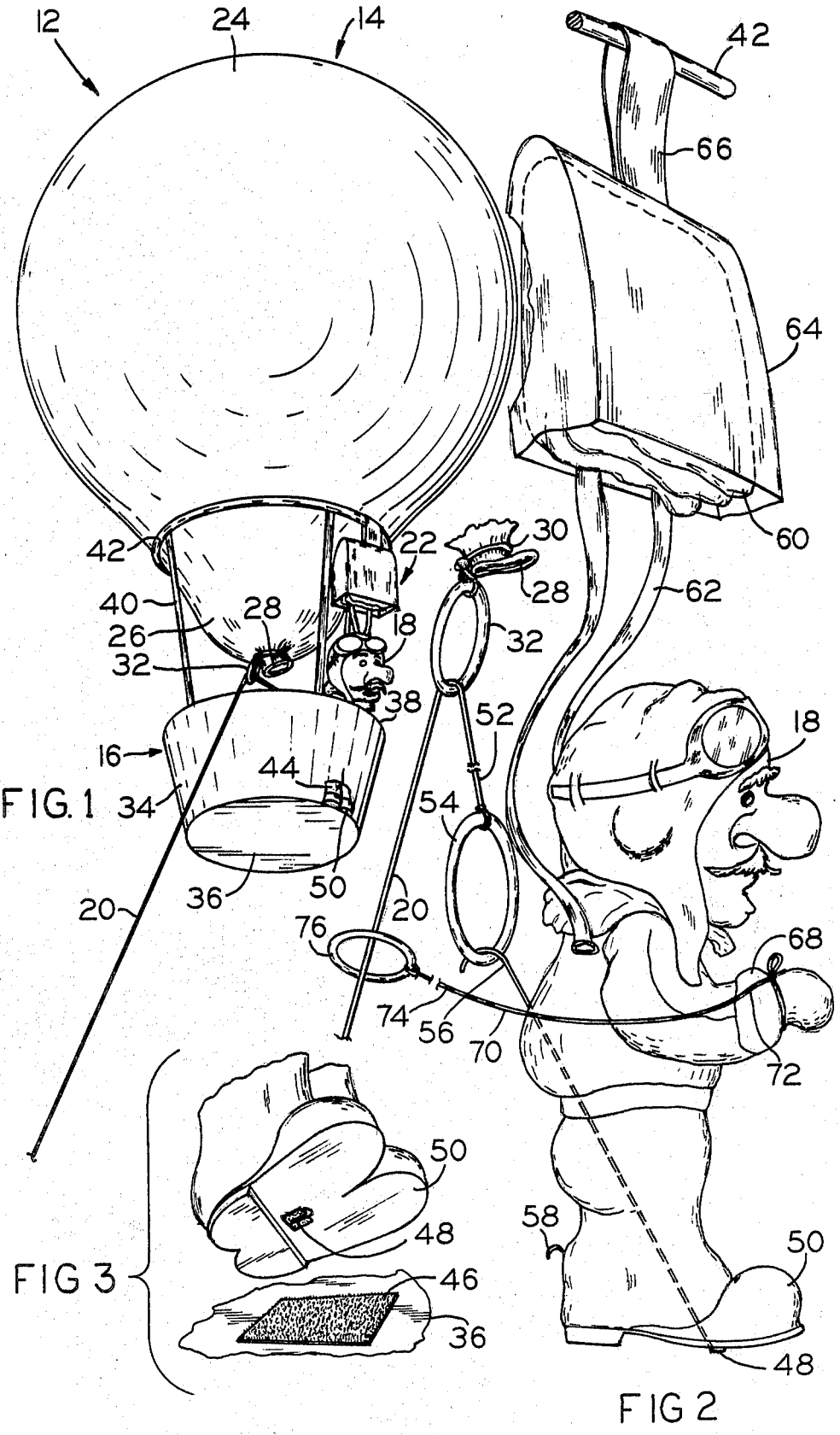
FIG. 1 is a perspective view of one embodiment of the invention.
FIG. 2 is an enlarged, fragmentary view of a portion of FIG. 1.
FIG. 3 is an enlarged, fragmentary view of a portion of FIG. 2.

Referring to FIG. 1, a toy aircraft 12 of the invention is depicted. Toy aircraft 12 comprises in greater part a vessel 14 adapted for containing a lighter-than-air gas, an object support 16 attached to vessel 14, an object 18 releasably positioned with object support 16, a line 20 slidably attached to vessel 14 and further releasably attached to object 18, and a descent device 22 for descending the object to the ground in a controllable manner.

Referring in greater detail to FIGS. 1, 2 and 3, a specific embodiment of the invention is illustrated. A balloon 24 having an undersurface 26 is inflated with a lighter-than-air gas such as helium. Balloon 24 may be constructed of a strong, lightweight material such as Mylar or a similar material, which is able to contain a gas such as helium without leakage, but whatever material is chosen, it is important that it be extremely light in weight. Balloon 24 is inflated with a lighter-than-air gas at nozzle 28 which is thereafter shut by manually tying the end thereof or by closing it off with a tie 30 or other means. A guiding device such as eyelet 32 is attached to undersurface 26 and is used to slidably receive line 20 therethrough. A basket 34 is provided to hold object 18. Basket 34 is rigidly suspended from undersurface 26 by frame 42 attached to undersurface 26 and a plurality of support members 40. Frame 42 may be mounted on undersurface 26 by using tape, glue or other adhesive material. Alternately, basket 34 may be suspended from undersurface 26 by taping support members 40 directly to undersurface 26 thereby eliminating frame 42. The rigid suspension required of basket 34 may be provided by constructing support members 40 of a lightweight plastic tubing, such as plastic straws or the like. Basket 34 further has a floor 36 and a wall 38 upstanding therefrom. Basket 34 is made of a lightweight material such as styrofoam, balsa wood or the like, and further has a slotted opening 44 in a portion of wall 38 adjacent to floor 36.

FIG. 2 illustrates object 18, which may simulate a human or other familiar figure as it would appear in basket 34 ready for flight. Object 18 is releasably attached to floor 36 of basket 34. A desirable method of releasably attaching object 18 to floor 36 is by using Velcro material, which generally consists of two layers with a first layer formed with minute loops or circles on its surface and a second layer having minute hooks formed on its surface. Contacting the two materials together causes the hooks of the one surface to attach to the loops or circles of the second surface thereby releasably attaching the two layers together. The attachment, however, is such that the two layers may be easily separated. A Velcro pad 46 having the loops or circles thereon is attached to floor 36 by use of tape, glue or the like. Likewise attached to the feet 50 of object 18 is Velcro strip 48 having the hooks thereon, which generally has a smaller surface area than Velcro pad 46 to ensure a releasable attachment of feet 50 to floor 36.

Line 20, slidably received through eyelet 32, has a first end 52 attached to a loop-shaped device such as ring 54. First end 52 may be secured to ring 54 by either tying it thereon, taping, gluing or the like. Ring 54 is then looped over a hook 56 extending from the back portion of object 18. The extended straight portion of hook 56 may continue through the body of object 18 penetrating at feet 50 to which Velcro strip 48 may be attached. Alternatively, hook 56 may be looped over a lower portion of object 18 such as bootstrap 58. Hook 56 may be made of a material such as wire, nylon or plastic in order to keep it lightweight.

Controlled descent is provided by parachute 60 which is attached to object 18 by a shroud line 62. Either one or a plurality of shroud lines 62 may be used to make the attachment of parachute 60 to object 18, or the parachute may be directly attached to object 18 without shroud lines. Also provided with parachute 60 is a bag 64 for lightly wedging parachute 60 therein. Bag 64 is attached by strap 66 to frame 42. This attachment may be made by either directly attaching strap 66 to bag 64 and frame 42, or by looping a portion of strap 66 between frame 42 and balloon 24 and attaching both ends to bag 64 by tape, glue or the like. The particular descent device 22 in this embodiment is a parachute 60, however, other means of controlled descent may also be used such as parasail, or an airfoil. An alternate means of releasably attaching object 18 within basket 34 may be accomplished by lightly wedging feet 50 in slotted opening 44. To prevent feet 50 from becoming lodged in slotted opening 44, mold flashing may be utilized around slotted opening 44. Assistance in releasing object 18 from basket 34 can be accomplished by the particular positioning of object 18 within basket 34; for example, by extending a portion of object 18 over wall 38. This may be easily accomplished by resting arm 68 on wall 48 or by providing a proboscidian projection over wall 38. Whatever portion is extended, its weight extending over wall 38 aids in releasing object 18 from basket 34.

A string 70 is provided to prevent object 18 from being blown by the wind into trees or buildings. String 70 has a first end 72 attached to arm 68 of object 18 by tying thereto, taping, gluing or in any other similar manner. String 70 has a second end 74 which is attached to line 20 by a sliding device such as ringlet 76. Ringlet 76 allows string 70 to slide down line 20 as object 18 controllably descends to the ground.

In operation, an operator (not shown) stands on line 20 thereby having use of both hands in positioning object 18 in basket 34 as explained above. The operator thereafter maintains control of toy aircraft 12 by holding line 20 or second end (not shown) of line 20. Toy aircraft 12 is then allowed to be carried aloft by the lighter-than-air gas contained in balloon 24. At a desired height, the operator may pull on line 20 sufficiently to release object 18 either from its Velcro attachment or the wedge attachment of feet 50 in slotted opening 44. As the first end 52 of the line 20 continues to pull up on either hook 56 or bootstrap 58, object 18 is tipped over wall 38 by the pulling action of line 20 and is further aided by the portion of object 18 which extends over wall 38. As object 18 is released from basket 34, ring 54 is simultaneously released from hook 56 or bootstrap 58 and proceeds upward toward eyelet 32 with which it becomes engaged thereby allowing continued control of toy aircraft 12 by line 20. As object 18 continues its downward descent, it releases parachute 60 from bag 64 with parachute 60 thereafter becoming spread open due to the upward air flow caused by the downward descent of object 18. As object 18 decends to the ground, it is prevented from drifting away by string 70 which is attached to arm 68 and slidably attached to line 20 by ringlet 76. Throughout this operation of toy aircraft 12 of the invention, the operator is required to operate only one line to fly the toy aircraft 12, release object 18 therefrom, and maintain control of object 18 and toy aircraft 12 thereafter.

Figure 7:
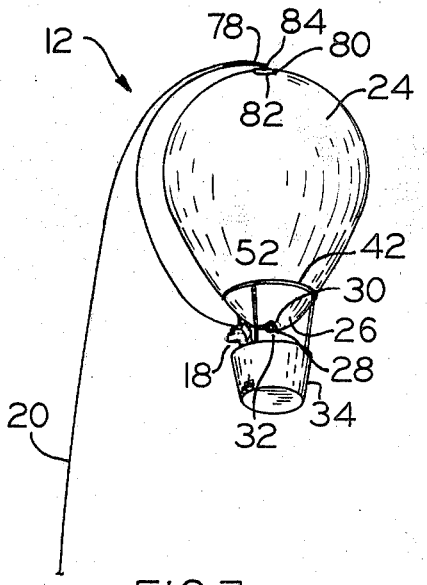
FIG. 7 is a perspective view of a third embodiment of the invention.
Figure 8:
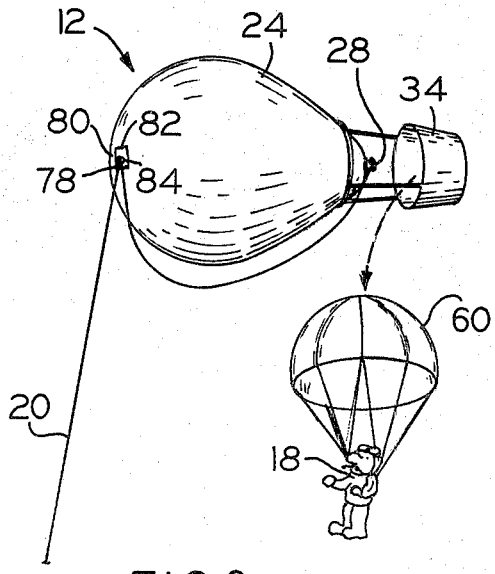
FIG. 8 is a perspective view of the invention of FIG. 7 after release of the object.
Figure 10:
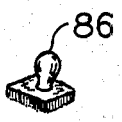
FIG. 10 depicts an alternate means of attaching the line to the invention in FIG. 7.
Figure 9:
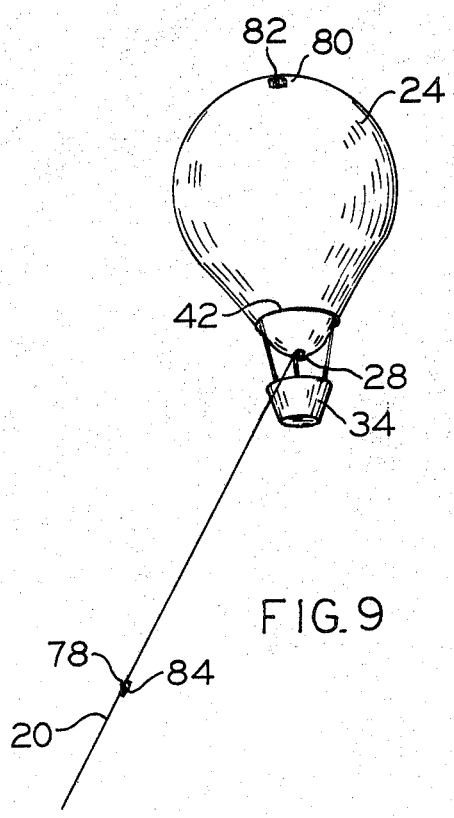
FIG. 9 is a perspective view of the invention of FIG. 7 depicting the invention in an upright fashion after release of the object.

A modification of the above embodiment is illustrated by FIGS. 7, 8 and 9. The modification is made in the releasing of object 18 from basket 34. Line first end 52 is attached to undersurface 26 at a convenient point such as nozzle 28, eyelet 32, or tie 30. The attachment of line first end 52 to undersurface 26, nozzle 28, tie 30 or eyelet 32 may be made in any manner as described above such as taping, gluing or tying directly thereto. A line midportion 78 is releasably attached to top surface 80 of balloon 24. This releasable attachment may be made by a Velcro pad 82 attached to top surface 80 and a Velcro strip 84 attached to line midportion 78. The releasable attachment is made by contacting Velcro strip 84 to Velcro pad 82. An alternate means of releasable attachment of line midportion 78 to top surface 80 is illustrated in FIG. 10. A peg 86 may be attached to top surface 80 in any manner as described above such as taping, gluing or the like. Line midportion 78 is then wound several times around peg 86, which is made of a lightweight material such as plastic or aluminum. At the desired height the operator pulls on line 20 thereby inverting toy aircraft 12 and spilling object 18 from basket 34. Object 18 may either be releasably attached to floor 36 as earlier described or merely placed within basket 34. Object 18 thereafter descends to the ground by use of a descent device such as a parachute 60, parasail, airfoil or the like, and is further controlled by string 70. To return aircraft 12 to an upright position and to maintain it in that posture, the operator tugs gently on line 20 thereby releasing line midportion 78 from its Velcro attachment to top surface 80 or by allowing line midportion 78 to unwind from peg 86. In either operation, toy aircraft 12 is thereafter returned to an upright position as depicted by FIG. 9.

Figure 4:
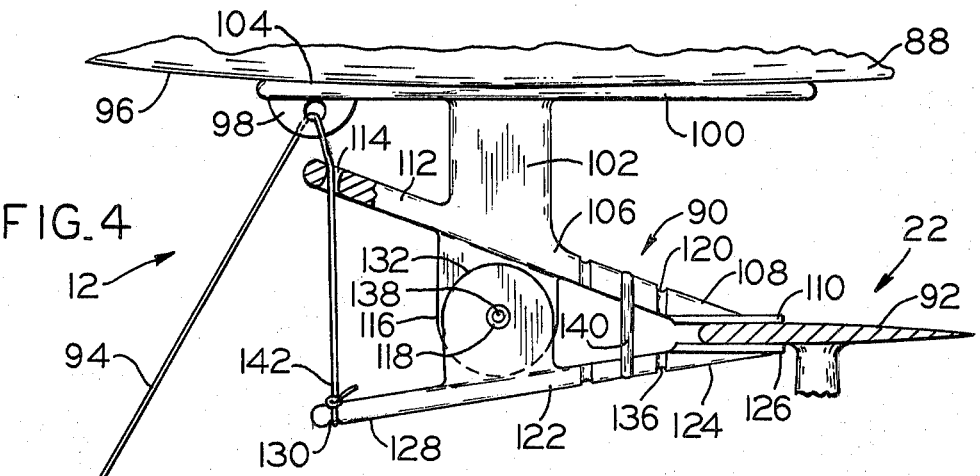
FIG. 4 is a side view of a second embodiment of the invention.
Figure 5:
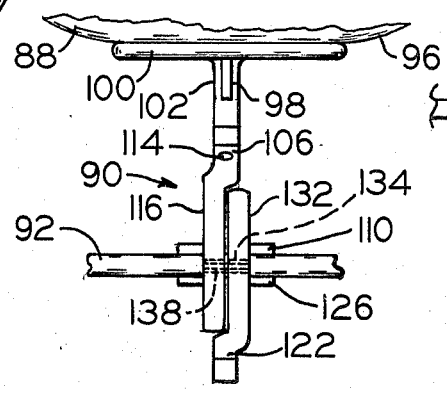
FIG. 5 is a front view of the embodiment of FIG. 4.
Figure 6:
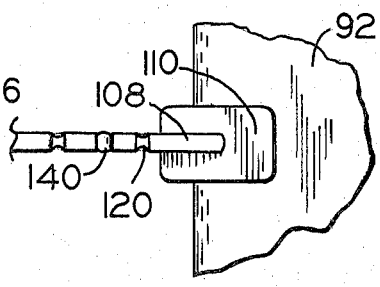
FIG. 6 is a top view of a fragmentary portion of FIG. 4.

A third embodiment of the invention is illustrated in FIGS. 4, 5 and 6. This embodiment of the invention comprises in major part blimp 88, a pincers clamp 90, an airfoil 92 attached to the object (not shown), and a line 94. Blimp 88 is constructed of a material such as Mylar or a like material, which is strong and light in weight, and able to contain a lighter-than-air gas, without leakage. Blimp 88 may be constructed in a collapsible manner whereby its inflation with the lighter-than-air gas causes it to assume its proper shape, or blimp 88 may be constructed of a lightweight material which is rigid enough to allow blimp 88 to maintain its correct shape without the lighter-than-air gas therein. In any event, the important requirement is that blimp 88 be made of a lightweight material such as Mylar. Attached to the undersurface 96 of blimp 88 is a guiding device such as eyelet 98 through which line 94 is slidably received. Eyelet 98 is attached to undersurface 96 by use of tape, glue, or the like.

Parenthetically, further attachments herein may be made in any manner as earlier described above in the first embodiment of this invention. Therefore, any attachment hereafter described is not to be understood as a limitation but only as a representative mode of attachment which may be made in other ways. In attaching eyelet 98 to undersurface 96, it is desirable that the location of the attachment be made at balance point 104 of blimp 88 to ensure stable control of toy aircraft 12 while aloft. A base 100 is attached to undersurface 96 and preferably aft of eyelet 98. Flange member 102 is attached to base 100 in a generally perpendicular manner and has pincers clamp 90 attached to the opposite end of flange member 102. Pincers clamp 90 comprises an upper arm 106 attached to flange member 102 and has an upper jaw end 108 with notches 120 thereon, an upper handle end 112 with a guide hole 114 therein, and a disc member 116 having a hole 118 therein and located between upper handle end 112 and upper jaw end 108. Upper jaw end 108 further has an upper jaw plate 110 attached thereto and generally parallel to undersurface 96 of blimp 88. If desired, upper arm 106, flange member 102 and eyelet 98 may be integral to base 100. Whether these elements are integral or not, it is still necessary that eyelet 98 be located at balance point 104, and accordingly eyelet 98 and base 100 are movable along undersurface 96 to ensure such location. Pincers clamp 90 further comprises a lower arm 122 having a lower jaw end 124 with notches 136 thereon, a lower handle end 128 having a guide hole 130 therein, disc member 132 integral to lower arm 122 and having a hole 134 therein and located between lower jaw end 124 and lower handle end 128. Lower jaw end 124 further has attached thereto lower jaw plate 126 generally parallel to upper jaw plate 110. Upper arm 106 and lower arm 122 are pivotably connected by pin 138 received through hole 118 of disc member 116 and hole 134 of disc member 132. Pincers clamp 90 is provided further with a tension device such as rubberband 140 to allow upper jaw end 108 and lower jaw end 124 to releasably maintain airfoil 92 between upper jaw plate 110 and lower jaw plate 126.

Airfoil 92 is attached to the object to allow for controlled descent of the object. Again, other descent devices are available for the object such as a parachute, parasail or the like. Line 94 is used to control blimp 88 by slidably passing line 94 through eyelet 98 and further passing line first end 142 through guide hole 114 of upper handle end 112 and through guide hole 130 of lower handle end 128. Line first end 142 is thereafter made secure to lower handle end 128 by any desired mode as previously described. The tension with which pincers clamp 90 holds airfoil 92 may be varied by using either one or a plurality of rubberbands 140 placed within notches 120, 136. Variable tension may be required due to wind conditions, weight of toy aircraft 12, or length of line 94. This variable tension capability further precludes the necessity of precision manufacturing of the pincers clamp 90.

In operation, the operator stands on line 94 allowing use of both hands in loading or positioning airfoil 92 in pincers clamp 90. Thereafter, the operator allows blimp 88 to become airborne carrying airfoil 92 and the object connected thereto. At a desired height, which is adjustable by paying out line 94 through eyelet 98, the operator pulls on line 94 sufficiently to draw lower handle end 128 towards upper handle end 112 thereby drawing lower jaw end 124 downward from upper jaw end 108 whereby airfoil 92 and the object are released for controlled descent to the ground. As earlier referred to above, the descent device 22 may be airfoil 92, a parachute, a parasail or the like. The object is controllably maintained by the operator in a manner similar to or identical to the first embodiment of the invention by use of a string similar or identical to string 70.

Figure 11:
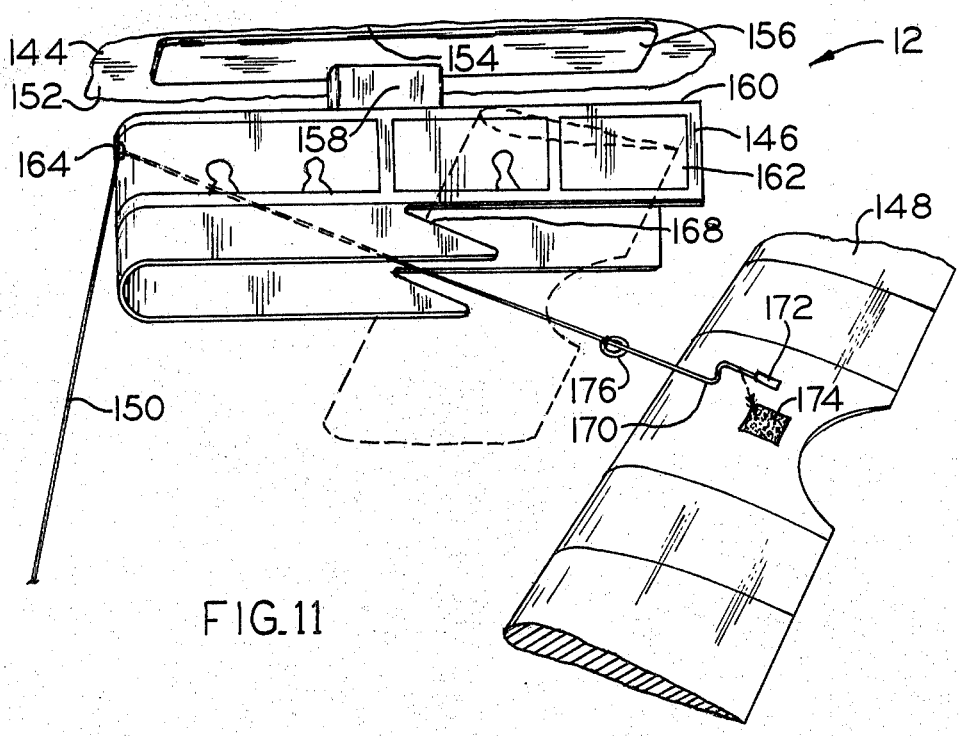
FIG. 11 is a perspective view of a fourth embodiment of the invention.

A further embodiment of the invention is depicted in FIG. 11. The toy circraft 12 comprises in greater part a blimp 144, a gondola 146, an airfoil 148 attached to an object (not shown), and a line 150. Blimp 144 has an undersurface 152 on which is located a balance point 154. Base 156 is attached to undersurface 152 at balance point 154 by use of adhesive tape, glue or the like. Attached to base 156 and below balance point 154 is flange member 158 generally perpendicularly disposed thereto. Gondola 146 is comprised of a top surface 160, a wall 162 downstanding therefrom and having a guiding device such as eyelet 164 therein, and at least one wedge slot 108 located in the undersurface of wall 162. The remote end of flange member 158 has top surface 160 attached thereto by tape, glue or the like. Line 150 is slidably attached to gondola 146 by being slidably received through eyelet 164. Line 150 further has a first end 170 releasably attached to airfoil 148. The releasable attachment is provided by a Velcro strip 172 attached to first end 170 and a Velcro pad 174 attached to airfoil 148. After release of the object, control of toy aircraft 12 is maintained by Velcro strip 172 or a retaining device such as ring 176 attached to line 150 between first end 170 and eyelet 164. Eyelet 164 is smaller in width than Velcro strip 172 or ring 176 thereby preventing Velcro strip 172 or ring 176 from passing therethrough and allowing line 150 to remain attached to gondola 146 for providing further control of toy aircraft 12 after release of object 18. Gondola 146, flange member 158, and base 156 may be integral or separate items. In either case, base 150 is movable along undersurface 152 to provide for its location at balance point 154.

In operation, the operator (not shown) stands on line 150 thereby having use of both hands to load or position airfoil 148 within wedge slot 168. Thereafter, the operator maintains a slight tension on line 150 to maintain the airfoil 148 in wedge slot 168 while allowing the blimp 144 to be carried aloft. At a desired height, the operator may gently tug on line 150 thereby releasing Velcro strip 172 from Velcro pad 174. As line 150 pays out through eyelet 164, ring 176 or Velcro strip 172 contacts eyelet 164 thereby permitting further control of blimp 144. The object (not shown) attached to airfoil 148 thereafter is controllably descended to the ground. As in the earlier described embodiments, the control of toy aircraft 12 and the release of the object is performed by a single line 150.

While this invention has been described as having specific embodiments, it will be understood that it is capable of still further modifications. This application is therefore intended to cover any further variations, uses or adaptations of the invention following the general principles thereof and including such departures from the present disclosure as come within known or customary practice in the art to which this invention pertains and fall within the limits of the appended claims.

What is claimed is:

1. A toy aircraft, comprising:

a blimp adapted for containing a lighter-than-air gas, and including a base attached to an undersurface thereof and a flange member connected to said base in a generally perpendicular manner, a gondola being attached to said flange member and having a top surface and a wall downwardly disposed therefrom, said gondola having a guide means, and a wedge slot in the bottom surface of said wall, an airfoil releasably attached to said gondola wedge slot, a line securely attached slidably to said gondola through said guide means, a first end of said line being releasably attached to said airfoil and a second end of said line held by an operator of said aircraft, an object attached to said airfoil, and a retaining means attached to said line for maintaining control of said blimp, whereby when said blimp becomes airborne said object may be released by pulling on said line and descended slowly to the ground.

2. A top aircraft, comprising:

a vessel adapted for containing a lighter-than-air gas, an object support being attached to said vessel, and having a guide means and a wedge slot therein, an airfoil releasably attached to said wedge slot, a line securely attached slidably to said object support through said guide means, a first end of said line being releasably attached to said airfoil and a second end of said line held by an operator of said aircraft, an object attached to said airfoil, and a retaining means on said line for maintaining control of said vessel.

3. A method of operating a toy aircraft, comprising:

providing a vessel adapted for containing a lighter-than-air gas and having a guide attached thereto with a line slidably received therein, inflating the vessel with a lighter-than-air gas, attaching to the vessel a gondola having a wedge slot in an undersurface thereof, attaching releasably to the gondola an airfoil having an object connected thereto by placing the airfoil in the wedge slot and releasably attaching a first end of a line to the airfoil by a hook and loop fastener, maintaining control of the vessel by a retaining device connected to the line between the guide and the line first end, flying the aircraft aloft, releasing the airfoil and object from the gondola by pulling on the line to release the line first end from the airfoil, descending controllably the object to the ground by means of the airfoil connected thereto, and maintaining control of the airfoil and object by a string attached to the object and slidably attached to the line.

4. A method of operating a toy aircraft, comprising:

providing a vessel adapted for containing a lighter-than-air gas, inflating the vessel with a lighter-than-air gas, attaching to the vessel an object support having a guide with a line slidably received therein and a wedge slot therein, attaching releasably to the vessel an airfoil having an object connected thereto by placing the airfoil in the wedge slot and releasably attaching a first end of the line to the airfoil, maintaining control of the vessel by a retaining device connected to the line between the guide and the line first end, flying the aircraft aloft, releasing the airfoil and object from the object support by pulling on the line to release the line first end from the airfoil, descending controllably the object to the ground by means of the airfoil, and maintaining control of the object by a string attached to the object and slidably attached to the line.

* * * * *